US010583060B2

(12) United States Patent
Reynolds et al.

(10) Patent No.: US 10,583,060 B2
(45) Date of Patent: Mar. 10, 2020

(54) CASKET INTERIOR TRIM SYSTEM

(71) Applicant: Batesville Services, Inc., Batesville, IN (US)

(72) Inventors: Kristine Ann Reynolds, Oldenburg, IN (US); Todd Jefferey Tekulve, Batesville, IN (US); Christopher M. Wessel, Metamora, IN (US); Gregory Wray, Guilford, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 16/036,171

(22) Filed: Jul. 16, 2018

(65) Prior Publication Data

US 2019/0015282 A1 Jan. 17, 2019

Related U.S. Application Data

(60) Provisional application No. 62/532,759, filed on Jul. 14, 2017.

(51) Int. Cl.
*A61G 17/04* (2006.01)

(52) U.S. Cl.
CPC ..... *A61G 17/042* (2016.11)

(58) Field of Classification Search
CPC ..... A61G 17/04; A61G 17/042; A47G 2009/004; A47G 9/00; A47G 9/02
USPC ..... 27/19; 5/485, 906, 923
See application file for complete search history.

(56) References Cited

U.S. PATENT DOCUMENTS

| | | | | | |
|---|---|---|---|---|---|
| 2,250,704 | A * | 7/1941 | Donnelly | A61G 17/04 | 27/19 |
| 2,718,687 | A * | 9/1955 | Woltering | A61G 17/04 | 27/19 |
| 2,775,021 | A * | 12/1956 | Bourgraf | A61G 17/04 | 27/6 |
| 3,014,261 | A * | 12/1961 | Nelson | A61G 17/04 | 24/380 |
| 3,218,688 | A * | 11/1965 | Slaughter | A61G 17/04 | 27/19 |
| 3,233,302 | A * | 2/1966 | Ross | A61G 17/04 | 229/922 |
| 3,246,379 | A * | 4/1966 | Slaughter | A61G 17/04 | 27/19 |
| 3,316,608 | A * | 5/1967 | Ross | A61G 17/04 | 27/19 |
| 5,737,785 | A * | 4/1998 | Casey | A45F 4/02 | 5/417 |
| 5,784,768 | A * | 7/1998 | Rojdev | A61G 17/04 | 24/DIG. 39 |
| 7,254,875 | B2 * | 8/2007 | Wray | A61G 17/04 | 27/19 |
| 2004/0016055 | A1 * | 1/2004 | Lamy | A47G 9/02 | 5/485 |
| 2004/0158960 | A1 * | 8/2004 | Shaw | A61G 17/04 | 27/14 |

(Continued)

*Primary Examiner* — William L Miller
(74) *Attorney, Agent, or Firm* — Wood Herron & Evans LLP

(57) ABSTRACT

A decorative casket interior trim system comprises a generally rectangular decorative fabric bottom panel, a pair of generally rectangular decorative fabric side panels, and a pair of generally rectangular decorative fabric end panels. Each of the panels is fabricated as a pocket. A semi-rigid sheet is inserted into each pocket.

13 Claims, 17 Drawing Sheets

(56) References Cited

U.S. PATENT DOCUMENTS

| | | | | |
|---|---|---|---|---|
| 2011/0107567 | A1* | 5/2011 | Cox | A61G 17/04 27/4 |
| 2012/0167309 | A1* | 7/2012 | Heidorn | A01M 1/103 5/691 |
| 2013/0191239 | A1* | 7/2013 | Bovard | G06Q 30/0621 705/26.5 |

* cited by examiner

CASKET INTERIOR TRIM SYSTEM

RELATED APPLICATIONS

This application claims the priority benefit of U.S. Provisional Patent Application No. 62/532,759 Jul. 14, 2017, which is hereby incorporated by reference herein as if fully set forth in its entirety.

FIELD OF THE INVENTION

This invention relates generally to caskets, and more particularly to interior trim systems for caskets.

BACKGROUND OF THE INVENTION

A conventional casket has a casket shell adapted to receive the remains of a deceased, and either a single lid or cap, or pair of lids or caps, pivoted to the shell. Single lid caskets are sometimes referred to as "full top" or "full couch" caskets, whereas caskets with separate head end and foot end lids are sometimes referred to as "split top" or "half couch" caskets. During viewing of a body in a split top casket, only the head end cap is raised, while during viewing of a body in a full top casket, the single full length cap is of course raised. In either instance, the interior of the casket is visible. It has heretofore been conventional to trim the interior of the casket with various decorative interior trim components to present an ornamentally pleasing appearance when the lid or lids is or are open.

In the case of so-called split top caskets, during viewing the head end lid is opened and the foot end lid remains closed. Decorative trim components are provided for the casket shell interior. For example, a decorative fabric mattress cover overlies the mattress on the body support structure mounted in the casket shell. A decorative fabric "big body" overlies the rim of the shell and extends into the interior of the shell and over a portion of the exterior of the shell. The big body extends from the head end of the closed foot end lid along the head end portion of the front side wall of the shell, around the front head end corner of the shell, and along the head end end wall of the shell. A decorative fabric "small body" overlies the rim of the shell and extends into the interior of the shell and extends from the head end of the closed foot end lid along the head end portion of the rear side wall of the shell to the head end end wall of the shell. A decorative fabric "overthrow" extends over the head end of the closed foot end lid and into the interior of the shell. A pillow with decorative fabric cover is placed on the mattress at the head end thereof. In the case of so-called full top caskets, the big body is a full length big body and extends along the head end end wall, entire front side wall, and foot end end wall of the shell, and the small body is a full length small body and extends from the head end end wall to the foot end end wall along the entire rear side wall of the shell.

Decorative trim components can also be provided for the underside of the casket lid, visible when the lid is open. A "dish assembly" is typically mounted within the underneath side of the lid. The dish assembly includes a generally rectangular cap panel and four convexedly shaped "puffing members" mounted around the periphery of the cap panel to the opposed longer sides and the opposed shorter ends of the cap panel. The dish assembly may or may not include a decorative cap panel insert that is removably installable between the four puffing members of the dish assembly. The cap panel and/or cap panel insert may be covered in decorative fabric or otherwise have ornamentation applied thereto which complements the fabric design used for the big body, small body, overthrow, mattress cover, and pillow cover. The cap panel and/or cap panel insert may be fabricated to include a sheet of ferrous metal covered in decorative fabric, to which ornamental medallions may be magnetically attached. A split top casket will typically have a dish assembly mounted in both the head end lid and the foot end lid, although typically only the head end lid will have decorative adornments with the foot end dish assembly being plain or basic. A full top casket will have a single dish assembly the full length of the casket, with or without additional decorative adornments.

Currently, in the manufacture of caskets, the casket is almost entirely or completely trimmed or dressed at the manufacture's location prior to shipment to the point of sale/point of purchase, for example funeral home, and thus only a limited degree of personalization is available to the casket purchaser at the time of purchase at the point of purchase. For example, various decorative casket shell corner ornaments can be selected by the purchaser to personalize the casket to the deceased. Such corner ornaments are installed on the casket shell corners by, for example, the funeral director at the funeral home at the time of purchase. As another example, various decorative cap panel inserts can be selected by the purchaser to personalize the casket to the deceased. Such cap panel inserts are also installed into the dish assembly by, for example, the funeral director at the funeral home at the time of purchase. As yet another example, various decorative medallions can be selected by the purchaser to personalize the casket to the deceased, which can be attached to the interior and/or the exterior of the casket shell and/or casket lid at the point of purchase.

It is desirable to make available to the casket purchaser additional opportunities to personalize the casket to the deceased.

It is also desirable to provide for new and innovative styles and designs of decorative casket interior trim components which may be quickly and easily installed.

SUMMARY OF THE INVENTION

In one aspect, a decorative casket interior trim system comprises a generally rectangular decorative fabric bottom panel having first and second longer sides and first and second shorter ends, a pair of generally rectangular decorative fabric side panels each of which has first and second longer sides and first and second shorter ends, one of the side panels positioned along and connected to the first longer side of the bottom panel and the other of the side panels positioned along and connected to the second longer side of the bottom panel, a pair of generally rectangular decorative fabric end panels each of which has first and second sides and first and second ends, one of the end panels positioned along and connected to one of the first and second shorter ends of one of the side panels and the other of the end panels positioned along and connected to the one of the first and second shorter ends of the other side panel, each of the panels fabricated as a pocket, and a semi-rigid sheet inserted into each pocket.

Lines of stitching can separate the bottom panel from the side panels and each end panel from a respective one of the side panels. The lines of stitching can form the pockets. A pair of spaced apart lines of stitching can separate the bottom panel from each side panel. Each semi-rigid sheet can be fabricated from corrugated cardboard or corrugated plastic.

The decorative casket interior trim system can further comprise a decorative magnetic frame adapted to be magnetically attached to a cap panel or cap panel insert of a casket, and a small body removably attached with hook and loop fasteners to a lower horizontal frame element of the magnetic frame, the small body adapted to drape downwardly over a rearmost one of the side panels when installed in the casket. The decorative casket interior trim system can further comprise a big body removably attached with hook and loop fasteners to the end panels and a forwardmost one of the side panels when installed in the casket and adapted to drape over and downwardly from a forwardmost upper edge of a shell of the casket and a head end upper edge of the shell of the casket.

In another aspect, a decorative casket interior trim system comprises a generally rectangular decorative fabric bottom panel having first and second longer sides and first and second shorter ends, a pair of generally rectangular decorative fabric side panels each of which has first and second longer sides and first and second shorter ends, one of the side panels positioned along and connected to the first longer side of the bottom panel and the other of the side panels positioned along and connected to the second longer side of the bottom panel, and a generally rectangular decorative fabric end panel having first and second longer sides and first and second shorter ends, the end panel positioned along and connected to one of the first and second shorter ends of the bottom panel and connected to corresponding ones of the first and second shorter ends of the side panels.

The decorative casket interior trim system can further comprise a decorative magnetic frame adapted to be magnetically attached to a cap panel or cap panel insert of a casket, and a small body removably attached with hook and loop fasteners to a lower horizontal frame element of the magnetic frame, the small body adapted to drape downwardly over a rearmost one of the side panels when installed in the casket. A lower edge of the small body can be removably attached with hook and loop fasteners to an upper edge of the rearmost one of the side panels when installed in the casket. An upper edge of the end panel and an upper edge of a forwardmost one of the side panels when installed in the casket can be adapted to be removably attached with hook and loop fasteners to an existing casket interior. The decorative casket interior trim system can further comprise a big body removably attached with hook and loop fasteners to the end panel and a forwardmost one of the side panels when installed in the casket and adapted to drape over and downwardly from a forwardmost upper edge of a shell of the casket and a head end upper edge of the shell of the casket.

In another aspect, a decorative casket interior trim system comprises a generally rectangular decorative fabric bottom panel having first and second longer sides and first and second shorter ends, a pair of generally rectangular decorative fabric side panels each of which has first and second longer sides and first and second shorter ends, one of the side panels positioned along and connected to the first longer side of the bottom panel and the other of the side panels positioned along and connected to the second longer side of the bottom panel, a pair of generally rectangular decorative fabric end panels each of which has first and second sides and first and second ends, one of the end panels positioned along and connected to one of the first and second shorter ends of one of the side panels and the other of the end panels positioned along and connected to the one of the first and second shorter ends of the other side panel, each of the panels fabricated as a pocket, and a semi-rigid sheet inserted into at least one of the pockets.

The pocket containing the semi-rigid sheet can be the bottom panel pocket.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
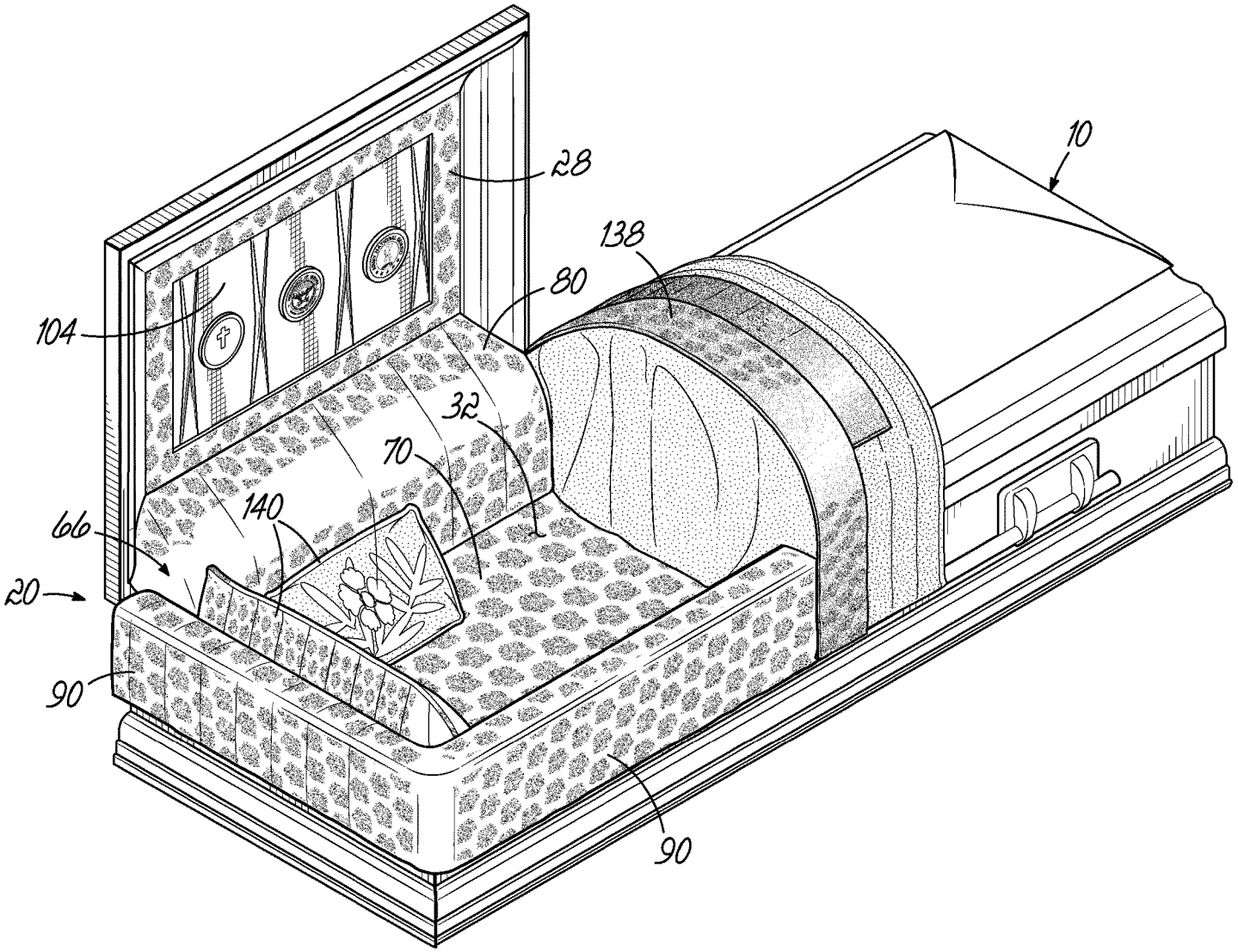
FIG. 1 is a front perspective view of one embodiment of the casket interior trim system.
Figure 2A:
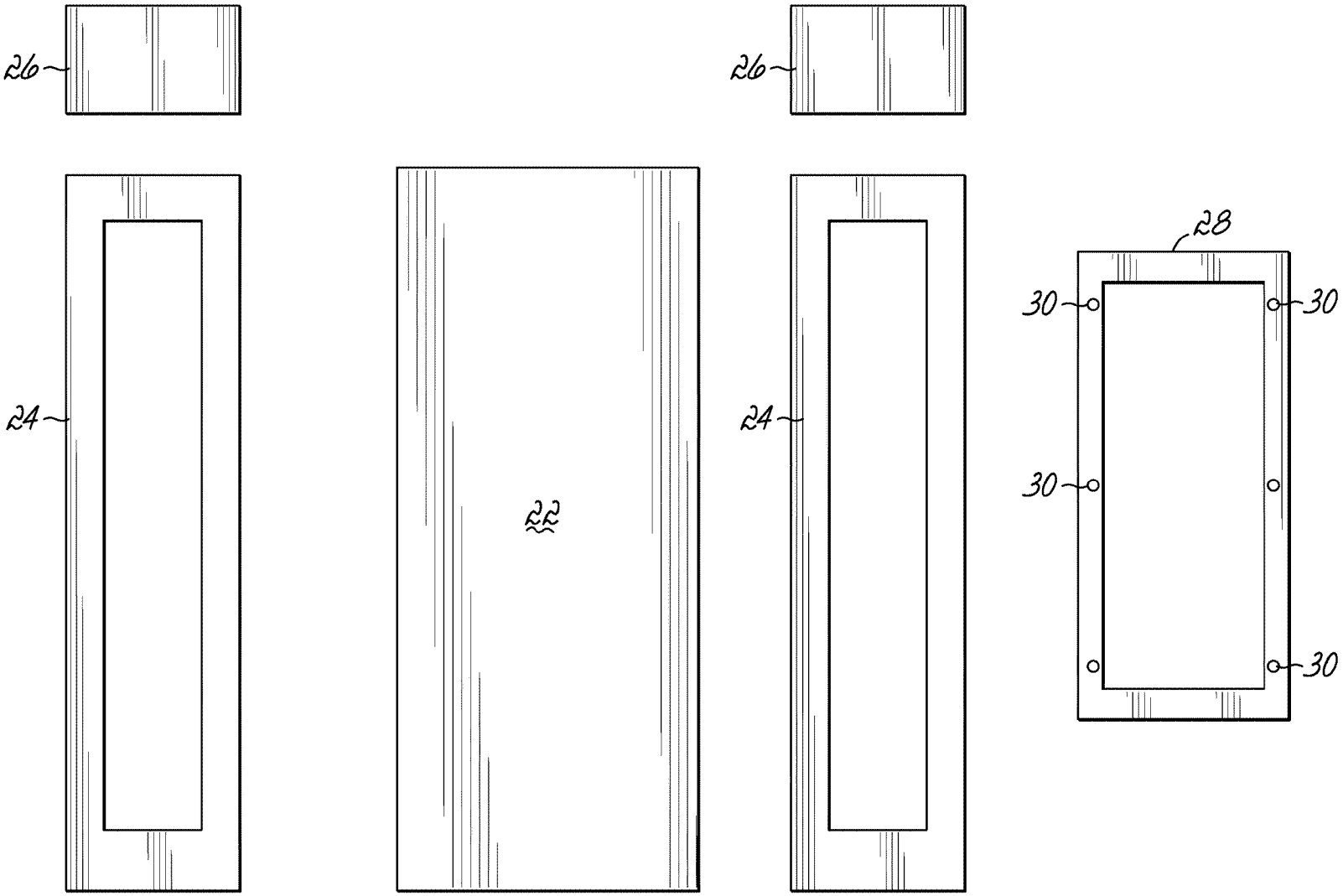
FIG. 2A is a top view of the semi-rigid sheets of the FIG. 1 embodiment.
Figure 2B:
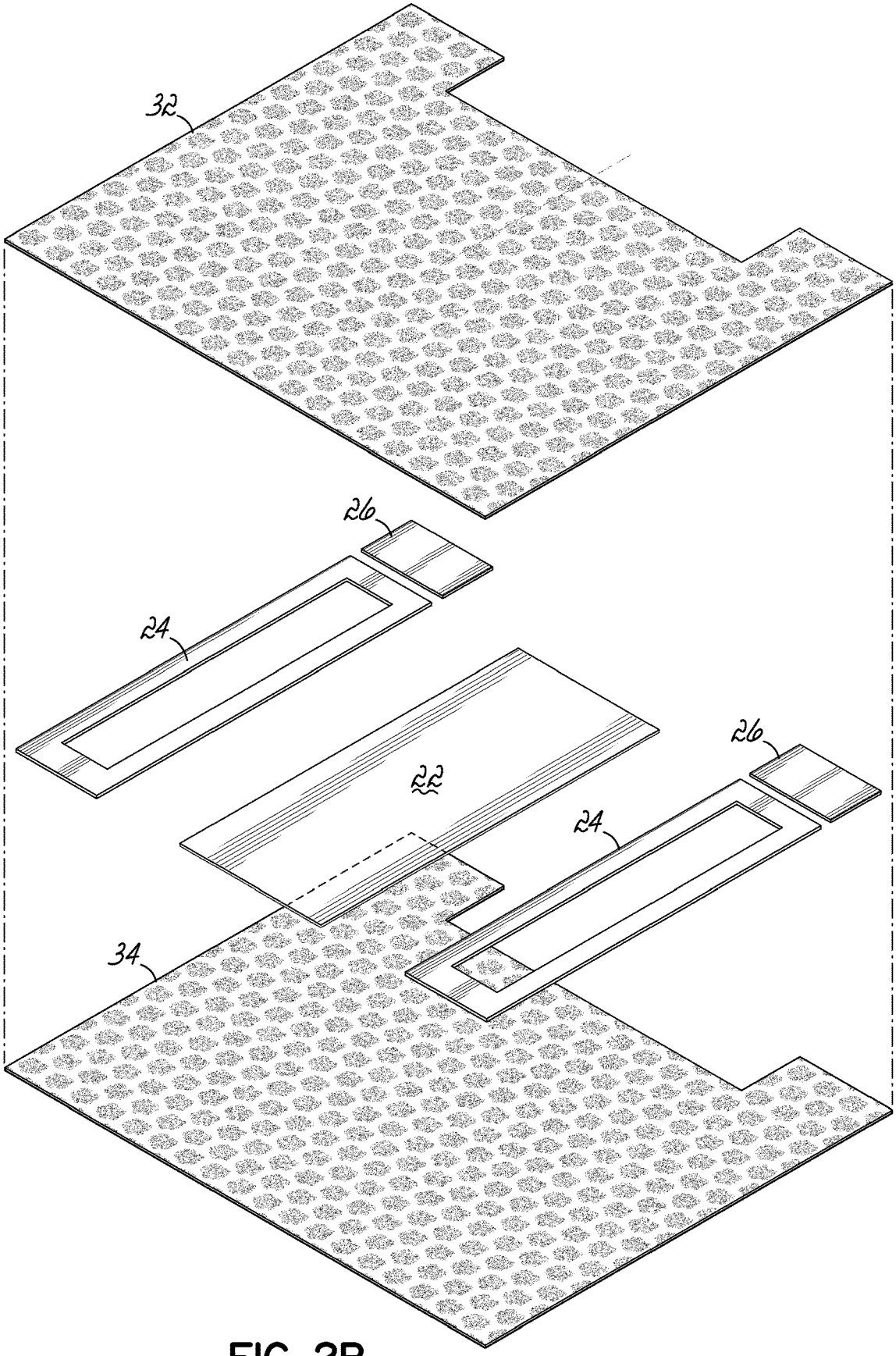
FIG. 2B is an exploded perspective view of the sheets of FIG. 2A positioned between upper and lower decorative fabric panels.
Figure 2C:
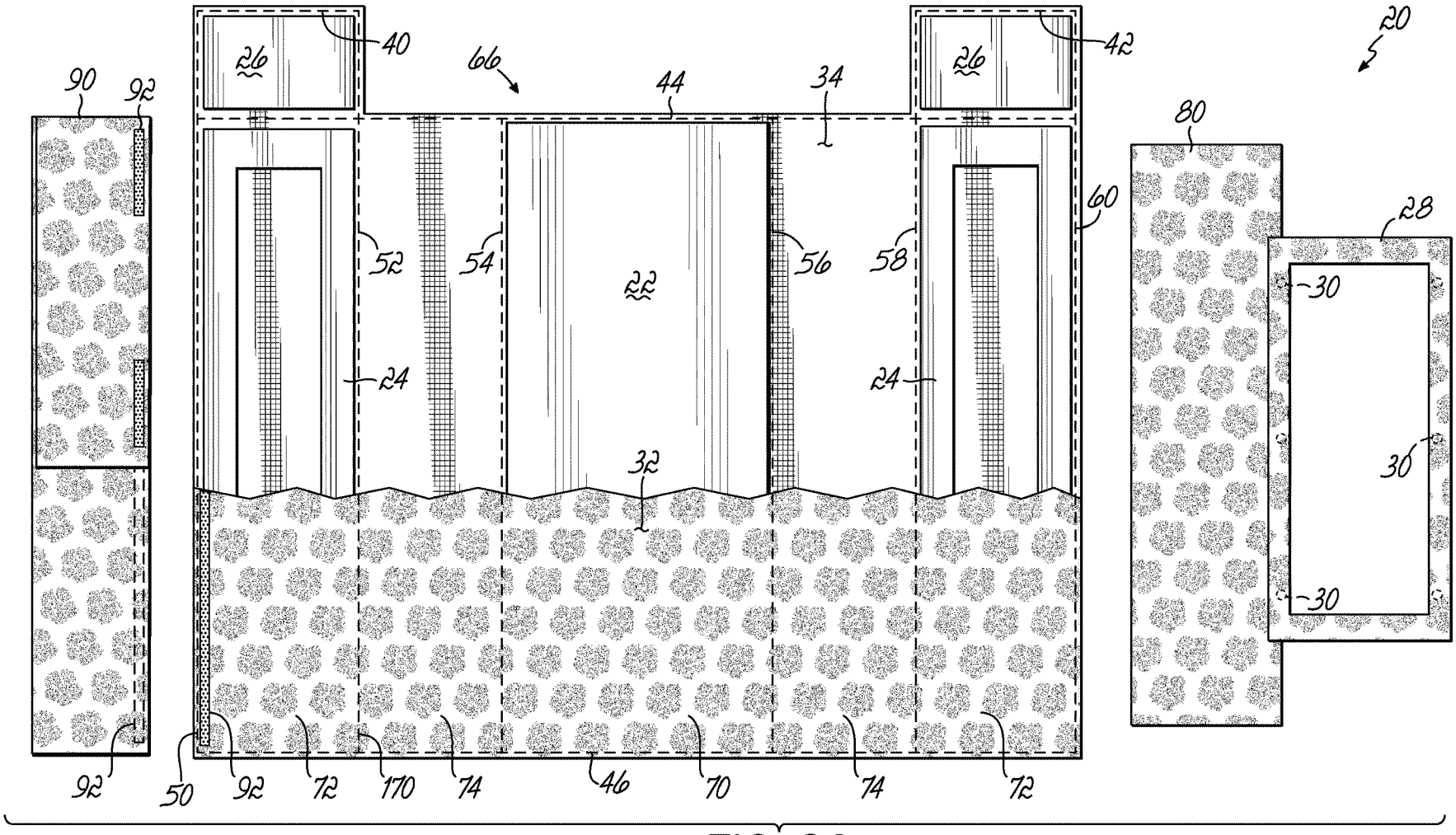
FIG. 2C is a top view, partially broken away, of the semi-rigid sheets sewn into pockets formed by the upper and lower decorative fabric panels, and of the decorative cap panel frame and small body.
Figure 2D:
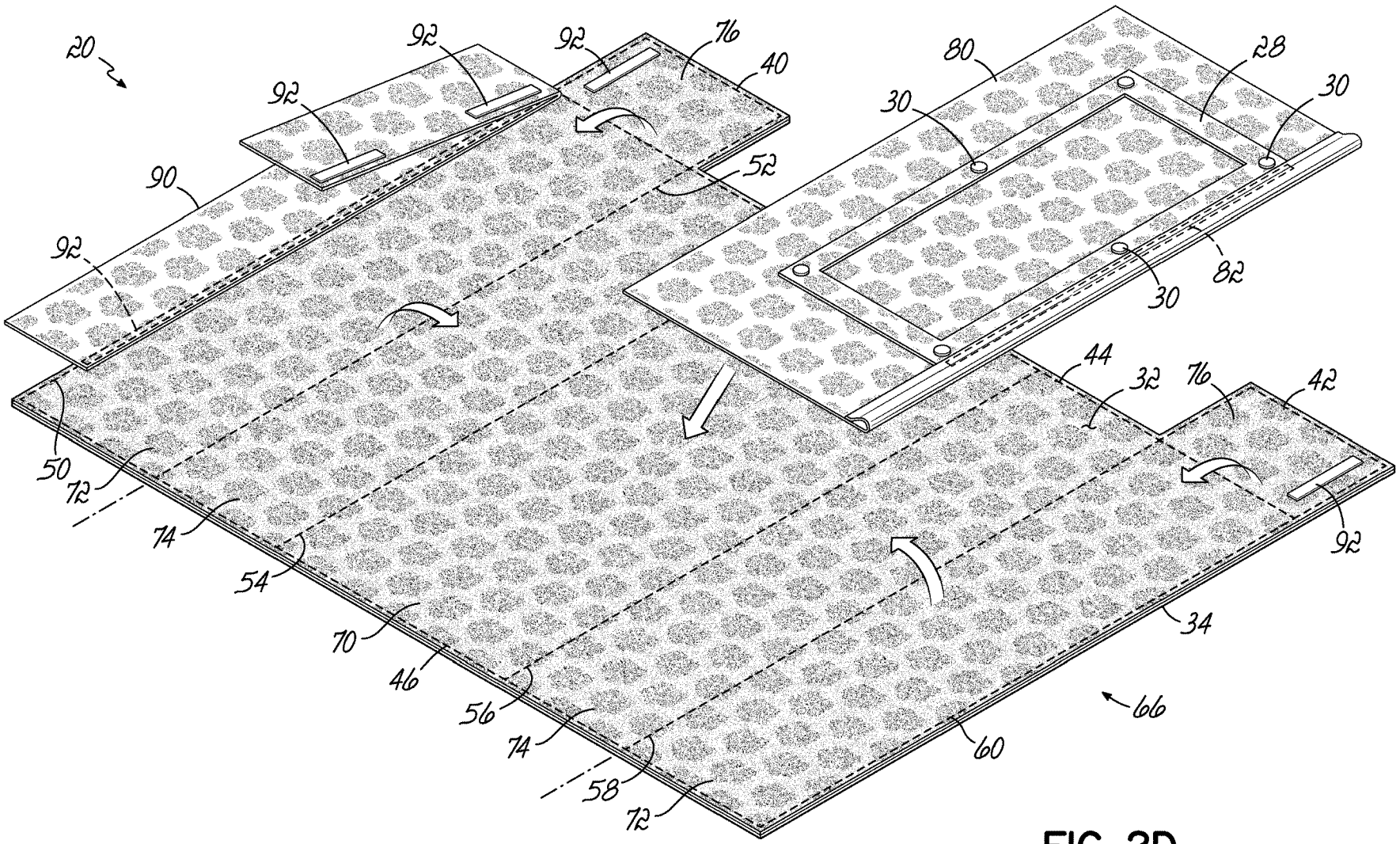
FIG. 2D is a perspective view of the bedding, cap panel frame, small body, and big body being folded for shipment.
Figure 3:
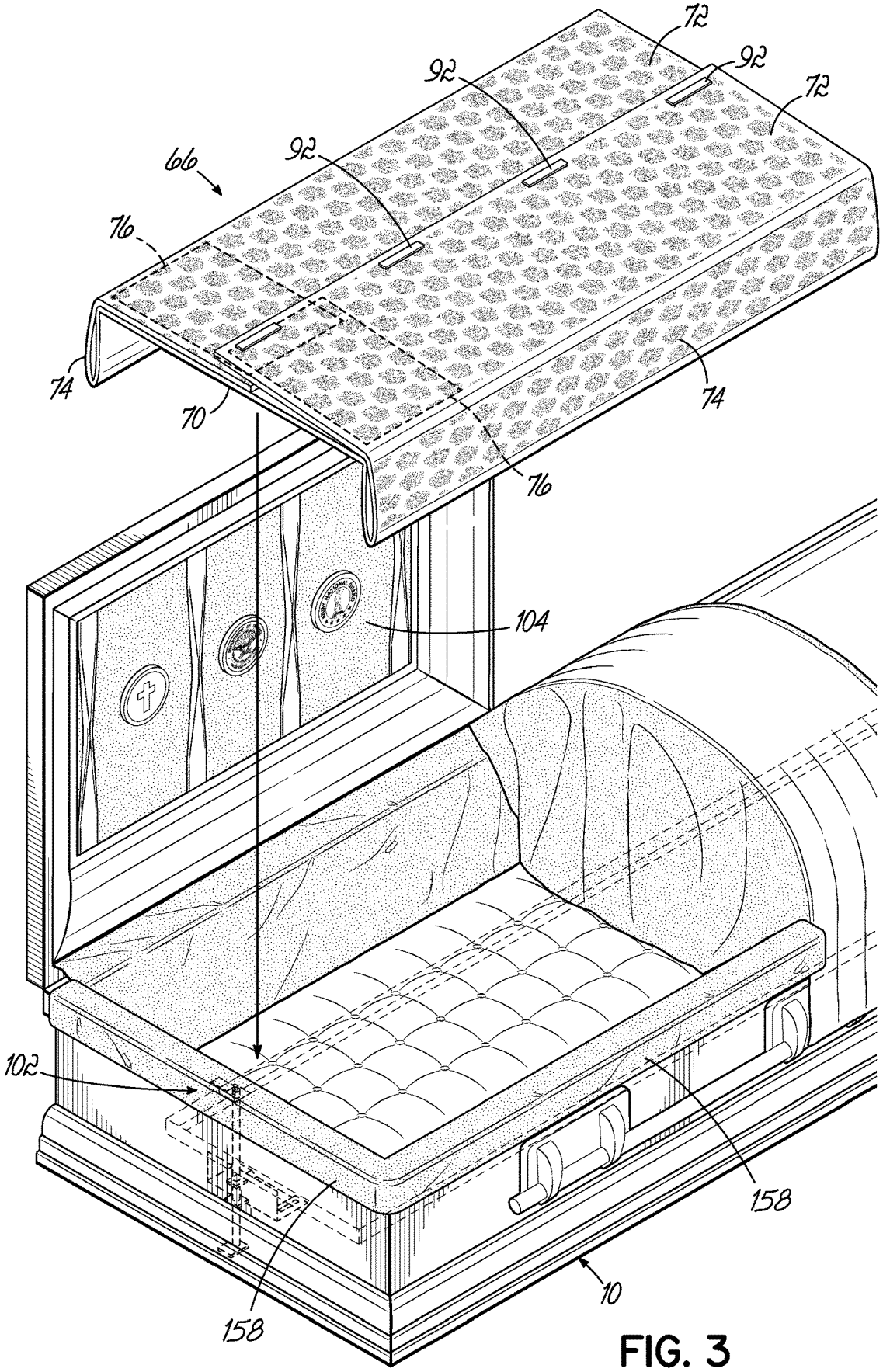
FIG. 3 is a front perspective view of an initial step in installing the interior trim system into a casket.
Figure 4A:
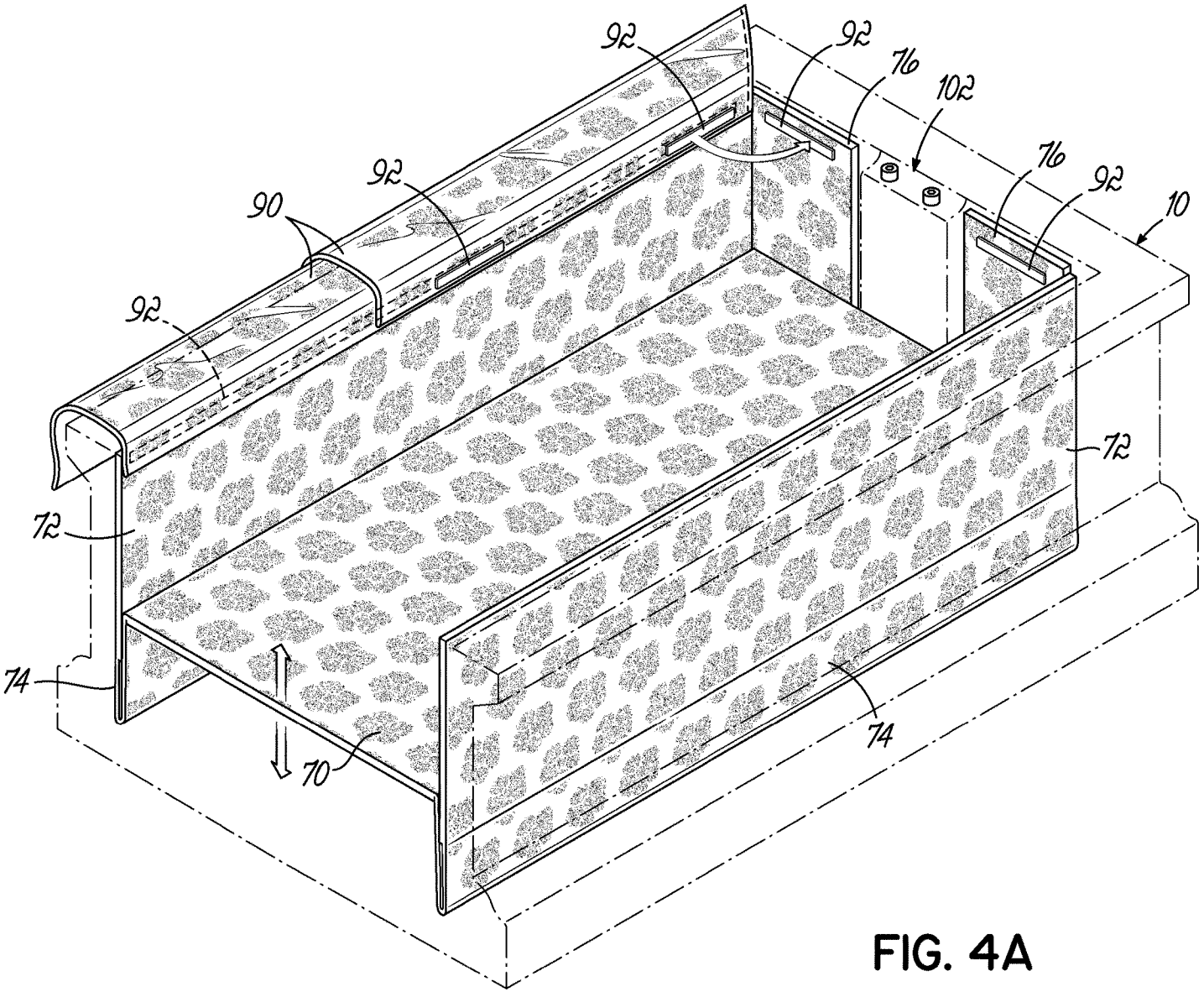
FIGS. 4A-4C are rear perspective views of subsequent steps in installing the interior trim system into a casket.
Figure 4B:
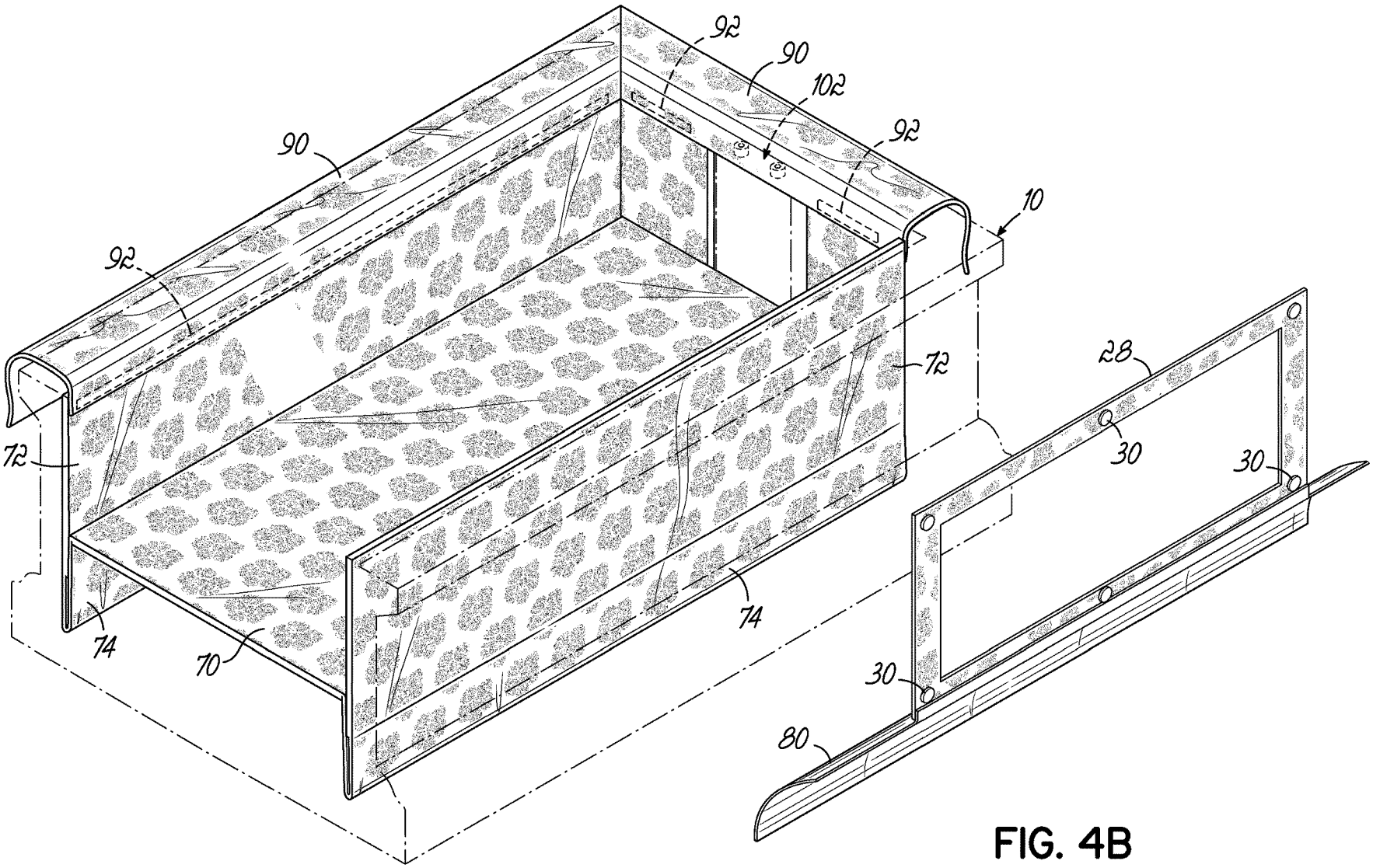
Figure 4C:
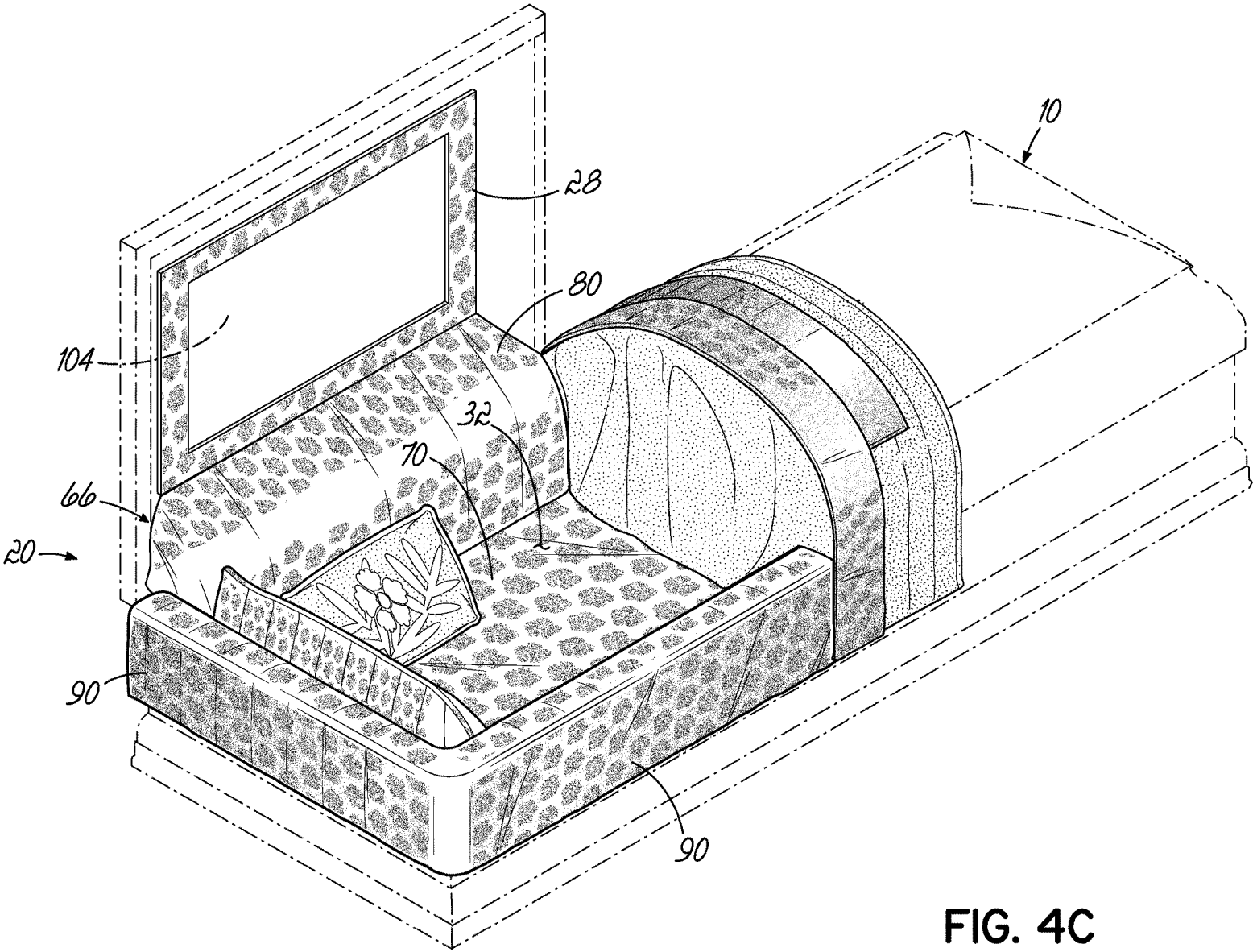

Referring to first to FIG. 1, there is illustrated a casket 10 with one embodiment of a casket interior trim system 20 installed therein.

Referring to FIG. 2A-2D, the system 20 includes a bottom sheet 22, two side sheets 24, two end sheets 26, and a rectangular cap panel frame 28. Cap panel frame 28 includes magnets 30 on a rear side thereof the purpose for which will be described below. The sheets 22, 24, and 26, and the cap panel frame 28, are preferably fabricated of a semi-rigid or semi-flexible material, such as corrugated cardboard or corrugated plastic.

The sheets 22, 24, and 26 are sandwiched between upper 32 and lower 34 decorative fabric panels. Four transverse lines of stitching 40, 42, 44, and 46, and six longitudinal lines of stitching 50, 52, 54, 56, 58, and 60, secure the sheets 22, 24, and 26 into pockets formed by the upper 32 and lower 34 decorative fabric panels so stitched. The resulting assembly produces bedding component 66 having a decorative bottom panel 70, two decorative side panels 72 hingedly connected to the bottom panel 70 via fabric sections 74 and lines of stitching 52, 54, 56, and 58, and two decorative end panels 76 hingedly connected to the side panels 72 via line of stitching 44. One or more of the sheets 22, 24, and 26 can be omitted if desired or required.

The cap panel frame 28 can be covered with matching decorative fabric matching that of the upper 32 and lower 34 decorative panels. A small body 80 can be removably attached with hook and loop fasteners 82 to a lower horizontal frame element of the magnetic cap panel frame 28, to drape downwardly over a rearmost one of the side panels 72 when installed in the casket 10. A big body 90 can be removably attached with hook and loop fasteners 92 to the end panels 76 and a forwardmost one of the side panels 72 when installed in the casket 10, to drape over and downwardly from a forwardmost upper edge of a shell of the casket 10 and a head end upper edge of the shell of the casket 10. Alternatively, the big body 90 can be stitched to the forwardmost one of the side panels 72, and removably attached with hook and loop fasteners 92 to just the end panels 76.

To install the trim system 20, and referring now to FIGS. 3 and 4A-4C, the bedding component 66 is placed into the casket 10 having a standard interior trim or lining 158 already installed. Side panels 72 are pivoted upwardly 90 degrees relative to bottom panel 70, and end panels 76 are pivoted outwardly 90 degrees relative to side panels 72. Fabric portions 74 are pressed downwardly at the longitudinal edges of the mattress 100. Big body 90 is attached to the forwardmost one of the side panels 72 and to both end panels 76 with hook and loop fasteners 92. The spacing between the ends of end panels 76 provides access to the lift/tilt mechanism 102 of the casket 10. The fabric portions 74 allow the mattress 100 to be raised and lowered via the lift/tilt mechanism 102 without disturbing the placement of side panels 72 and end panels 76 during lifting and lowering. Finally, small body 80 is attached to magnetic cap panel frame 28 via hook and loop fasteners 82, and magnetic cap panel frame 28 is attached to ferrous cap panel 104 via magnets 30.

Figure 5:
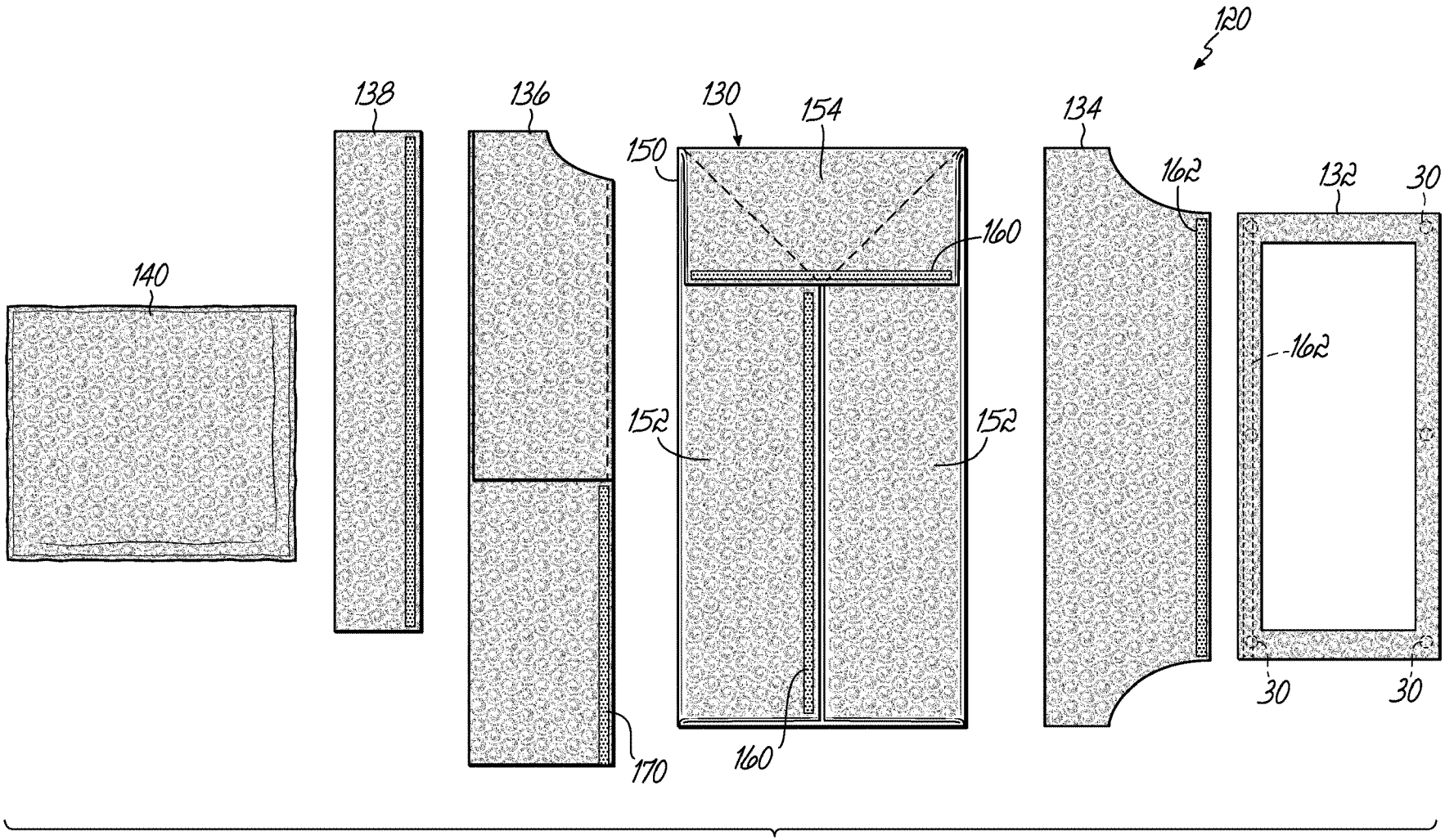
FIG. 5 is top view of another embodiment of casket interior trim system.
Figure 6A:
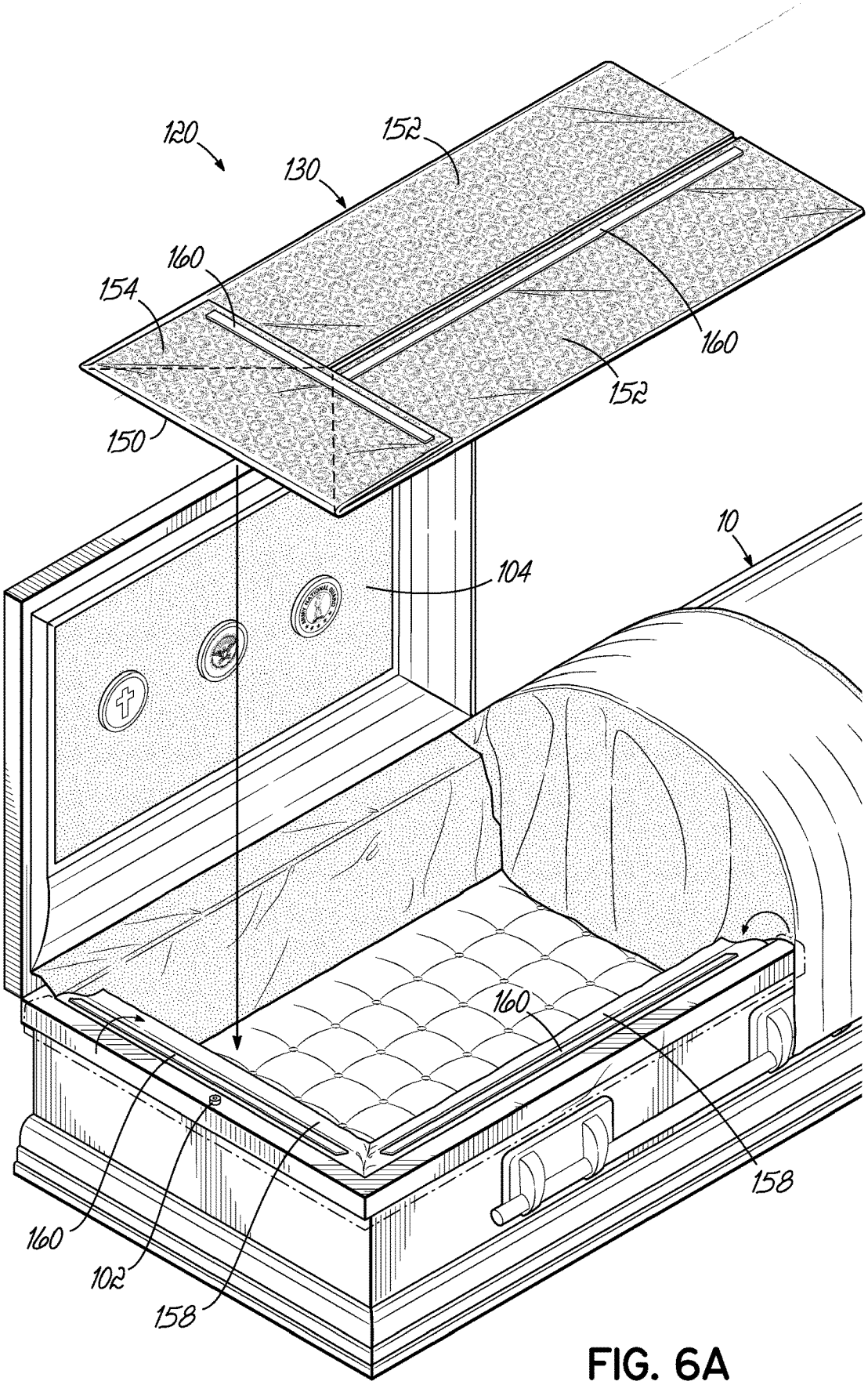
FIGS. 6A-6D are front perspective views of initial steps in installing the interior trim system of FIG. 5 into a casket.
Figure 6B:
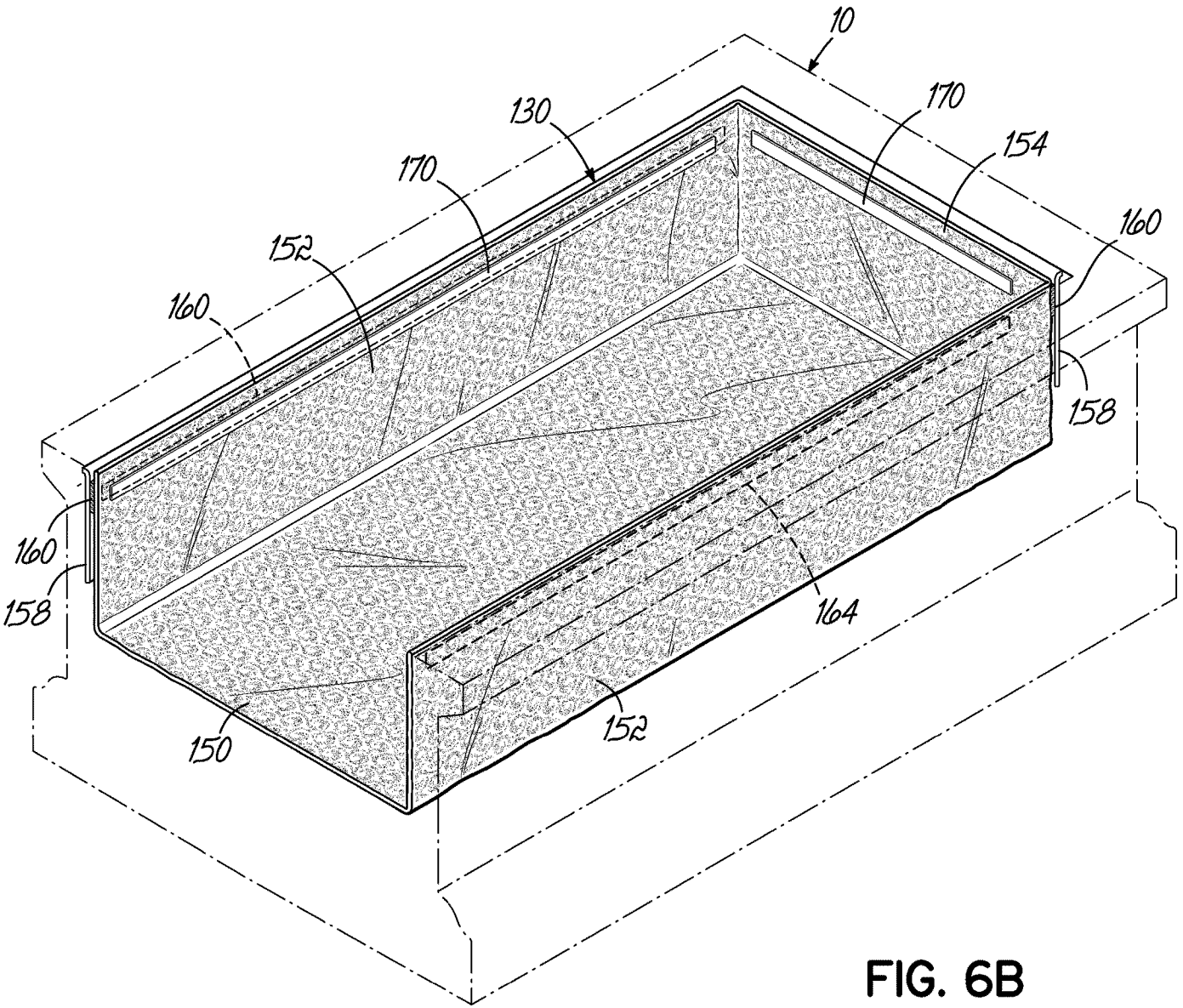
Figure 6C:
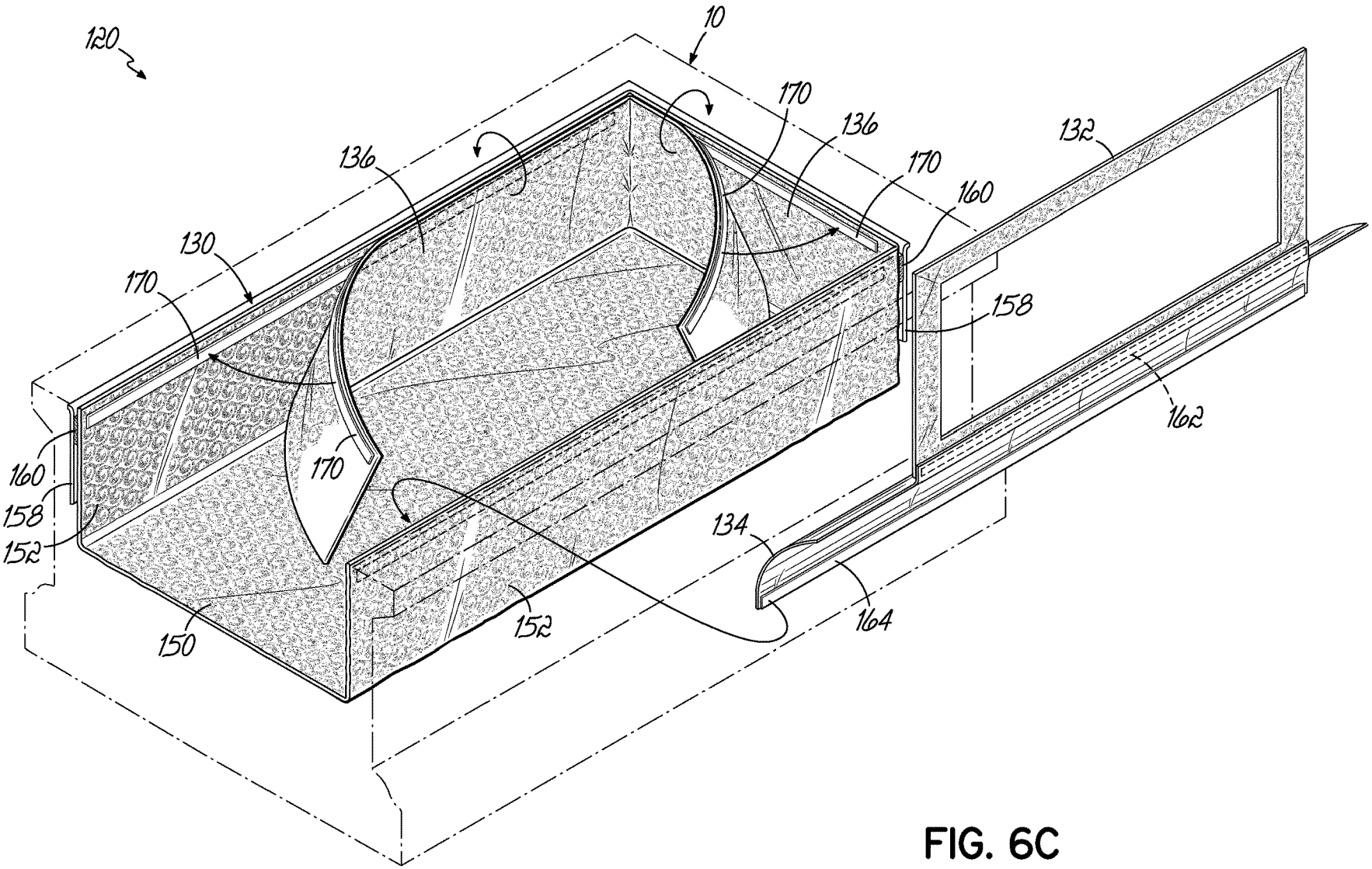
Figure 6D:
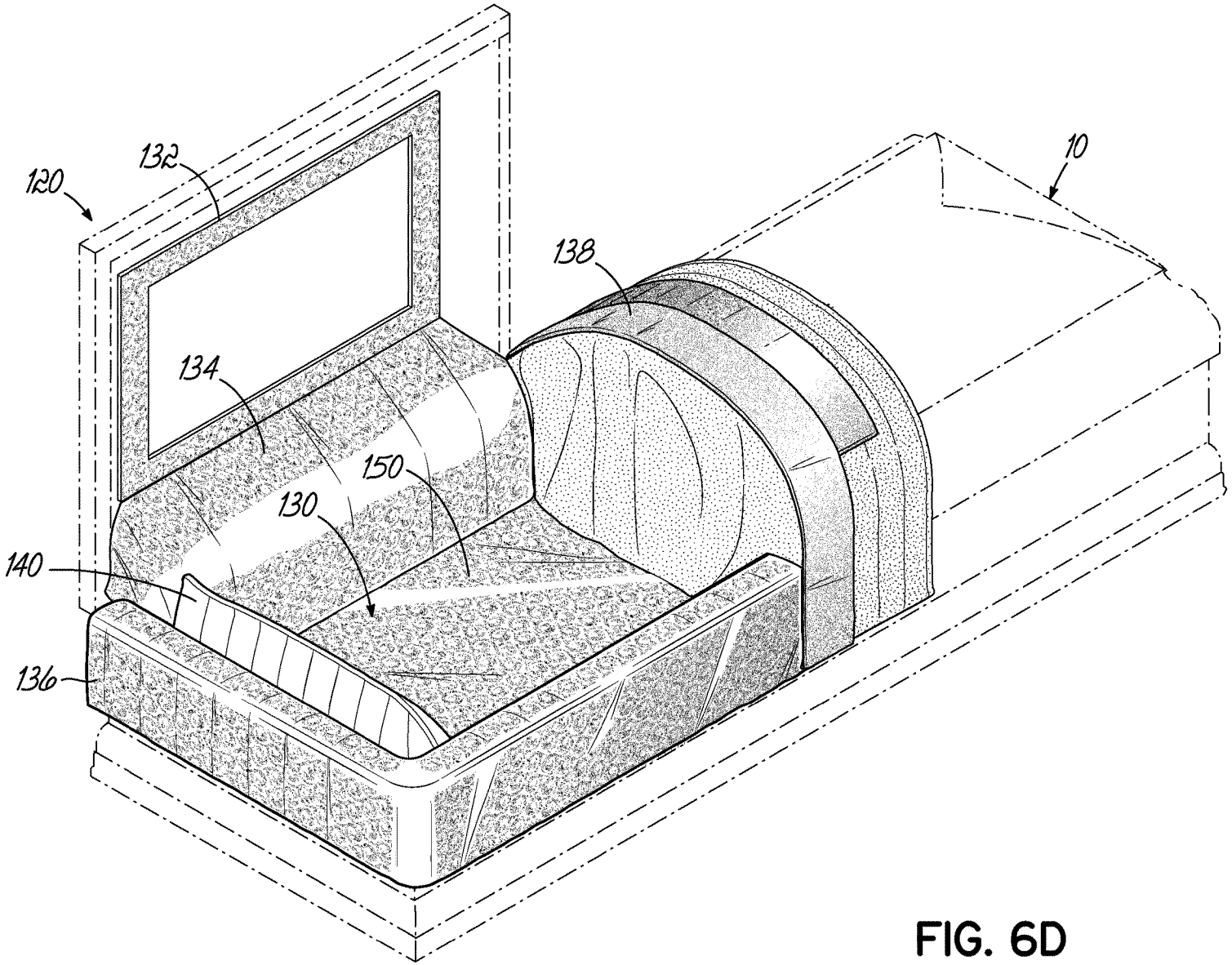
Figure 7A:
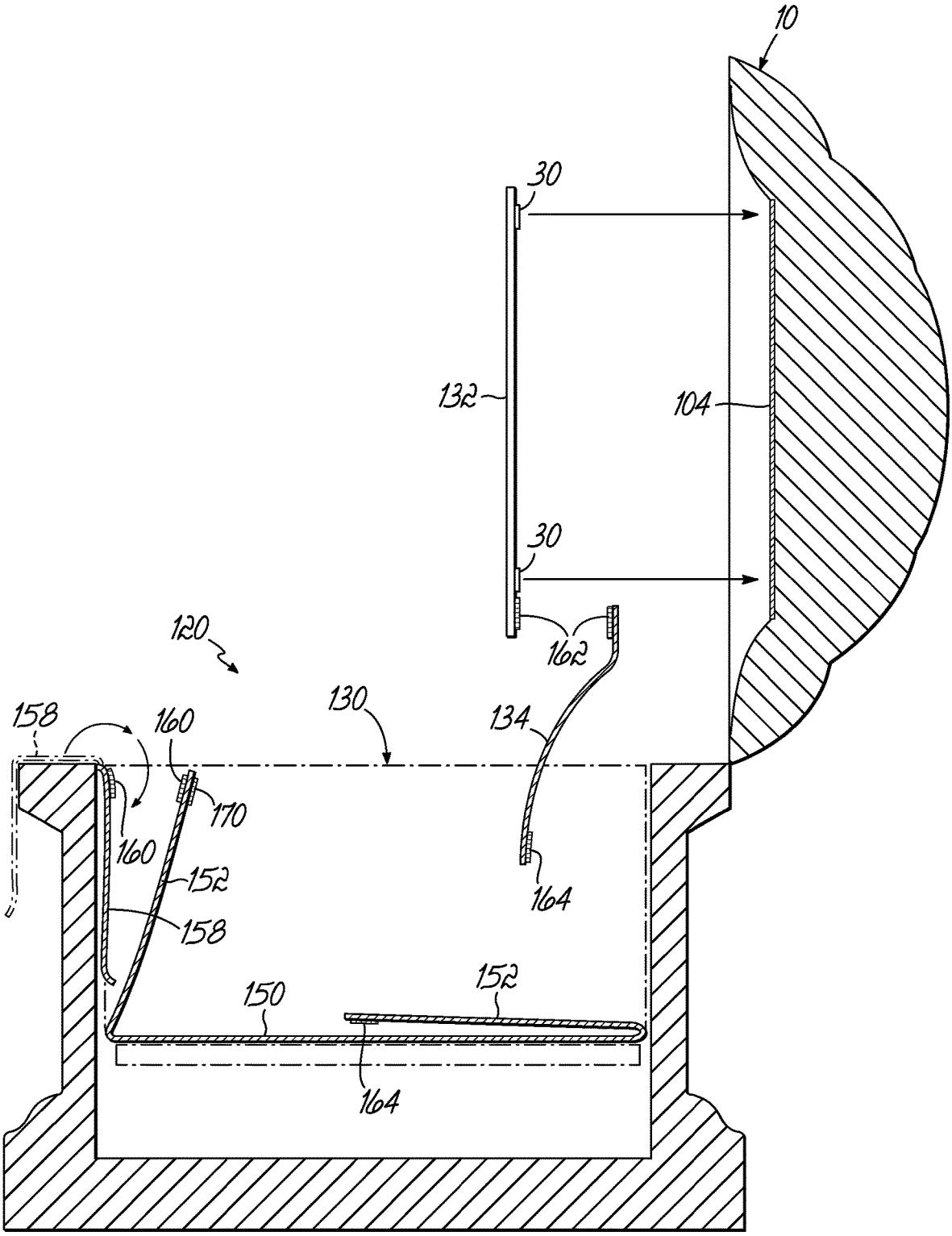
FIGS. 7A-7C are cross-sectional views of subsequent steps in installing the interior trim system into a casket.
Figure 7B:
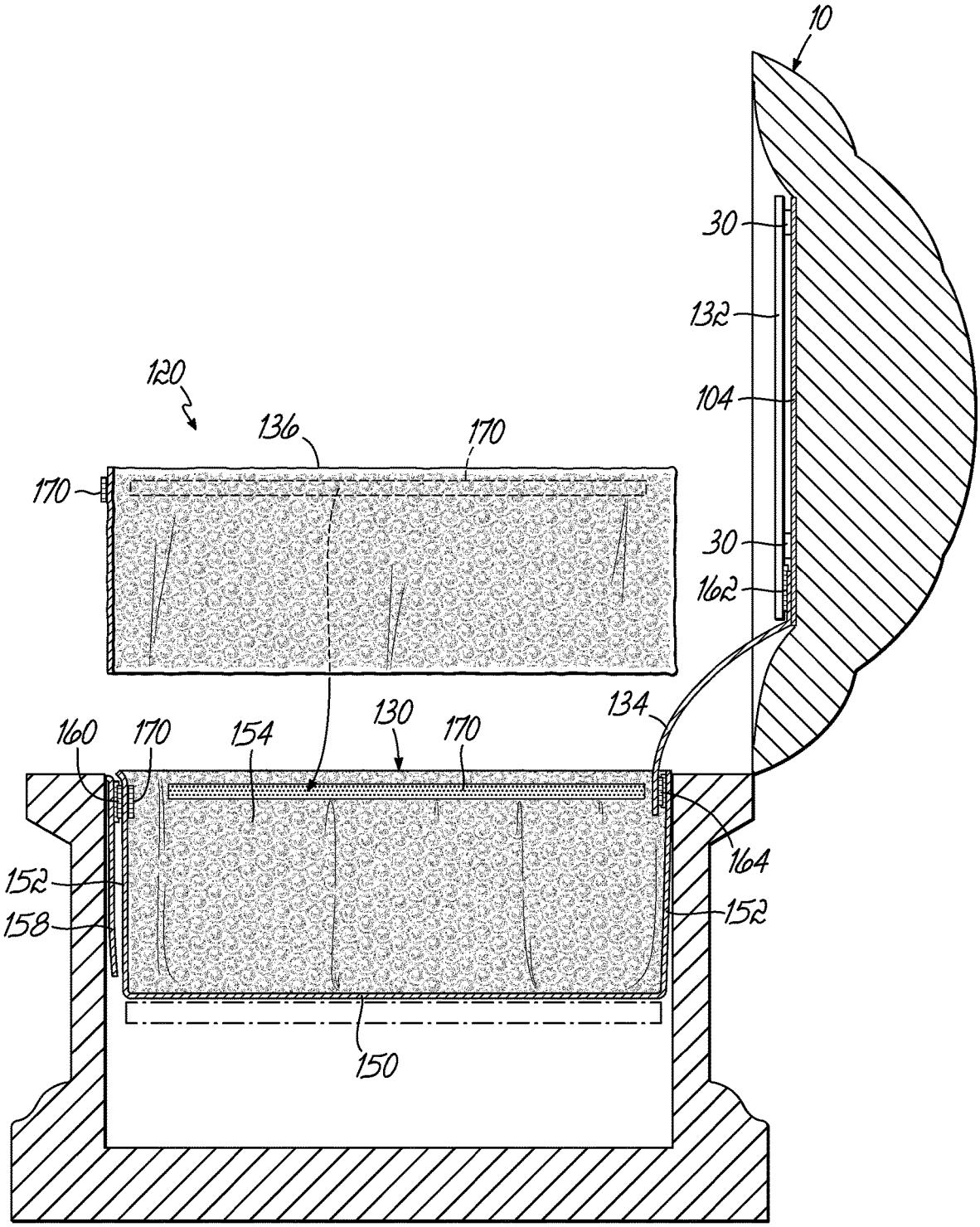
Figure 7C:
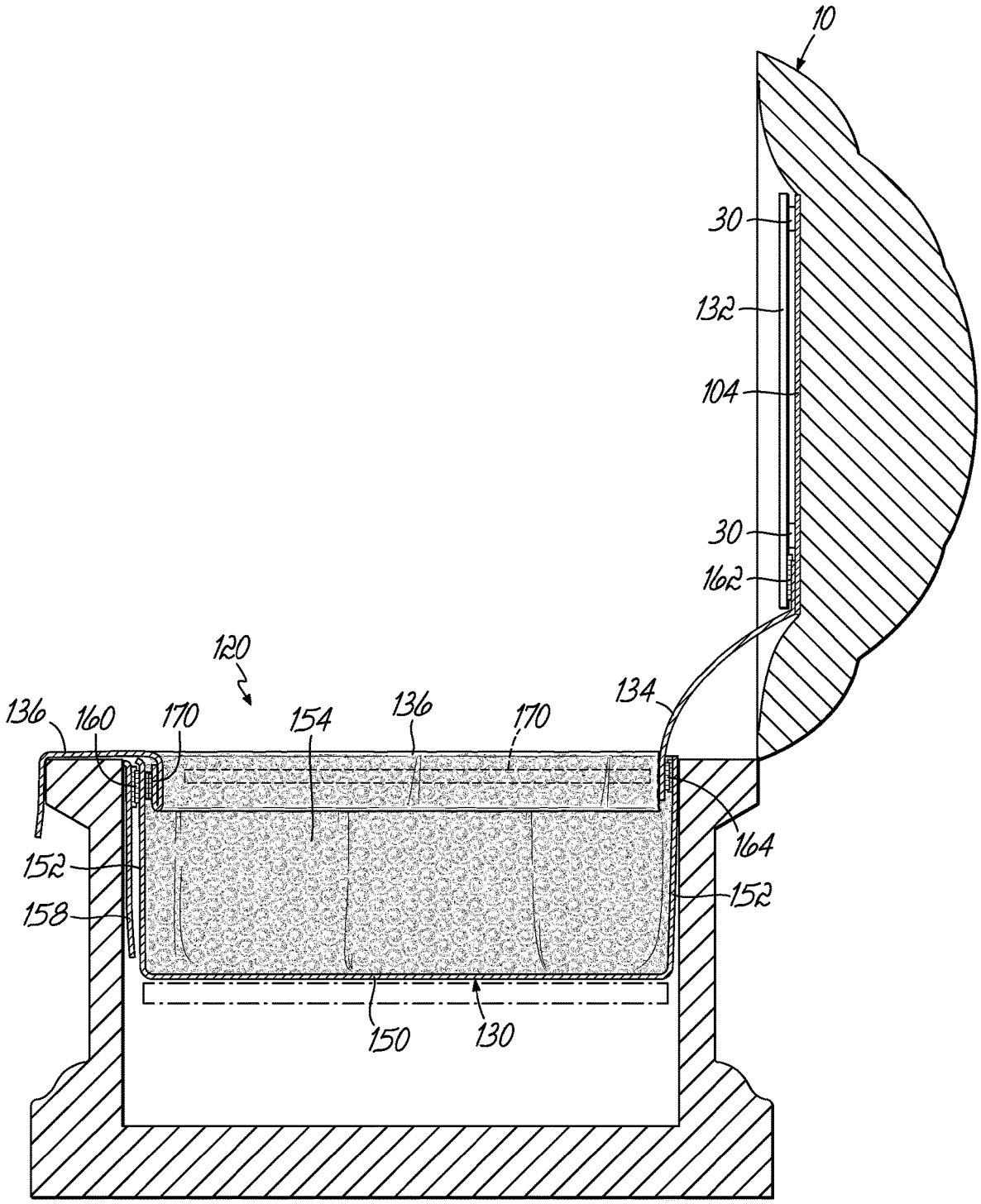

Referring now to FIG. 5, there is illustrated another embodiment of a casket interior trim system 120. In this embodiment, the semi-rigid panels of the FIGS. 1-4C embodiment have been eliminated. The interior trim system 120 includes a bedding component 130, a magnetic rectangular cap panel frame 132, a small body 134, a big body 136, an accent runner 138, and a pillow case 140.

Referring now to FIGS. 6A-7C, the bedding component 130 has a decorative fabric bottom panel 150, a pair of decorative fabric side panels 152, and a decorative fabric end panel 154, all connected to one another. Since the bedding component 130 does not include the semi-rigid panels of the previous embodiment, the side panels 152 and end panel 154 must have another means to maintain them in a smooth, upright orientation. To that end, the standard interior trim or lining 158 includes hook and loop fasteners 160 that interface with hook and loop fasteners 160 on the forwardmost decorative side panel 152 and decorative end panel 154.

As in the previous embodiment, the magnetic rectangular cap panel frame 132 attaches to ferrous cap panel 104, and a small body 134 is removably attached with hook and loop fasteners 162 to a lower horizontal frame element of the magnetic cap panel frame 132. Unlike the previous embodiment, however, the small body 134 is shorter, and includes hook and loop fasteners 164 along its lower edge that removably attaches to hook and loop fasteners 164 on the upper edge of the rearwardmost decorative side panel 152, thereby keeping that side panel 152 in a smooth, upright orientation. Alternatively, if small body 134 is not utilized, the rearwardmost decorative side panel 152 can simply be tucked up under the small body of the standard interior trim or lining 158.

To install the trim system 120, and referring still to FIGS. 6A-7C, the bedding component 130 is placed into the casket 10 having a standard interior trim or lining 158 already installed. The side panels 152 and end panel 154 are then pivoted upwardly 90 degrees relative to the bottom panel 150. The forwardmost side panel 152 and the end panel 154 are secured in their smooth, upright orientation via the hook and loop fasteners 160 attached to the upper edges of the forwardmost side panel 152 and the end panel 154 and to the standard interior trim or lining 158. Next the upper edge of small body 134 is attached to the lower edge of the magnetic cap panel frame 132 via hook and loop fasteners 162, the magnetic cap panel frame 132 is attached to ferrous cap panel 104, and the lower edge of small body 134 is attached to the upper edge of the rewardmost side panel 152 via hook and loop fasteners 164 to maintain that rewardmost side panel 152 in a smooth, upright orientation. Finally, big body 136 is attached to the upper edges of the forwardmost side panel 152 and the end panel 154 via hook and loop fasteners 170, and flipped outwardly so as to drape over and downwardly from the forwardmost upper edge of the shell of the casket 10 and a head end upper edge of the shell of the casket 10.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. The invention resides in each individual feature described herein, alone, and in all combinations of any and all of those features. Departures may therefore be made from such details without departing from the spirit or scope of the general inventive concept. Accordingly, the scope of the invention shall be limited only by the following claims and their equivalents.

What is claimed is:

1. A decorative casket interior trim system comprising:

a generally rectangular decorative fabric bottom panel having first and second longer sides and first and second shorter ends, a pair of generally rectangular decorative fabric side panels each of which has first and second longer sides and first and second shorter ends, one of said side panels positioned along and connected to said first longer side of said bottom panel and the other of said side panels positioned along and connected to said second longer side of said bottom panel, a pair of generally rectangular decorative fabric end panels each of which has first and second sides and first and second ends, one of said end panels positioned along and connected to one of said first and second shorter ends of one of said side panels and the other of said end panels positioned along and connected to said one of said first and second shorter ends of the other said side panel, each of said panels fabricated as a pocket, and a semi-rigid sheet inserted into each said pocket, wherein lines of stitching separate said bottom panel from said side panels and each said end panel from a respective one of said side panels.

2. The decorative casket interior trim system of claim 1 wherein said lines of stitching form said pockets.

3. The decorative casket interior trim system of claim 1 wherein a pair of spaced apart lines of stitching separate said bottom panel from each said side panel.

4. The decorative casket interior trim system of claim 1 wherein each said semi-rigid sheet is fabricated from corrugated cardboard.

5. The decorative casket interior trim system of claim 1 wherein each said semi-rigid sheet is fabricated from corrugated plastic.

6. A decorative casket interior trim system comprising:

a generally rectangular decorative fabric bottom panel having first and second longer sides and first and second shorter ends, a pair of generally rectangular decorative fabric side panels each of which has first and second longer sides and first and second shorter ends, one of said side panels positioned along and connected to said first longer side of said bottom panel and the other of said side panels positioned along and connected to said second longer side of said bottom panel, a pair of generally rectangular decorative fabric end panels each of which has first and second sides and first and second ends, one of said end panels positioned along and connected to one of said first and second shorter ends of one of said side panels and the other of said end panels positioned along and connected to said one of said first and second shorter ends of the other said side panel, each of said panels fabricated as a pocket, and a semi-rigid sheet inserted into each said pocket, further comprising:

a decorative magnetic frame adapted to be magnetically attached to a cap panel or cap panel insert of a casket, and a small body removably attached with hook and loop fasteners to a lower horizontal frame element of said magnetic frame, said small body adapted to drape downwardly over a rearmost one of said side panels when installed in the casket.

7. The decorative casket interior trim system of claim 6 further comprising a big body removably attached with hook and loop fasteners to said end panels and a forwardmost one of said side panels when installed in the casket and adapted to drape over and downwardly from a forwardmost upper edge of a shell of the casket and a head end upper edge of the shell of the casket.

8. A decorative casket interior trim system comprising:

a generally rectangular decorative fabric bottom panel having first and second longer sides and first and second shorter ends, a pair of generally rectangular decorative fabric side panels each of which has first and second longer sides and first and second shorter ends, one of said side panels positioned along and connected to said first longer side of said bottom panel and the other of said side panels positioned along and connected to said second longer side of said bottom panel, and a generally rectangular decorative fabric end panel having first and second longer sides and first and second shorter ends, said end panel positioned along and connected to one of said first and second shorter ends of said bottom panel and connected to corresponding ones of said first and second shorter ends of said side panels, further comprising:

a decorative magnetic frame adapted to be magnetically attached to a cap panel or cap panel insert of a casket, and a small body removably attached with hook and loop fasteners to a lower horizontal frame element of said magnetic frame, said small body adapted to drape downwardly over a rearmost one of said side panels when installed in the casket.

9. The decorative casket interior trim system of claim 8 wherein a lower edge of said small body is removably attached with hook and loop fasteners to an upper edge of said rearmost one of said side panels when installed in the casket.

10. The decorative casket interior trim system of claim 8 wherein an upper edge of said end panel and an upper edge of a forwardmost one of said side panels when installed in the casket are adapted to be removably attached with hook and loop fasteners to an existing casket interior.

11. The decorative casket interior trim system of claim 8 further comprising a big body removably attached with hook and loop fasteners to said end panel and a forwardmost one of said side panels when installed in the casket and adapted to drape over and downwardly from a forwardmost upper edge of a shell of the casket and a head end upper edge of the shell of the casket.

12. A decorative casket interior trim system comprising:

a generally rectangular decorative fabric bottom panel having first and second longer sides and first and second shorter ends, a pair of generally rectangular decorative fabric side panels each of which has first and second longer sides and first and second shorter ends, one of said side panels positioned along and connected to said first longer side of said bottom panel and the other of said side panels positioned along and connected to said second longer side of said bottom panel, a pair of generally rectangular decorative fabric end panels each of which has first and second sides and first and second ends, one of said end panels positioned along and connected to one of said first and second shorter ends of one of said side panels and the other of said end panels positioned along and connected to said one of said first and second shorter ends of the other said side panel, each of said panels fabricated as a pocket, and a semi-rigid sheet inserted into at least one of said pockets, wherein said bottom panel comprises said at least one pocket.

13. A decorative casket interior trim system comprising:

a generally rectangular decorative fabric bottom panel having first and second longer sides and first and second shorter ends, a pair of generally rectangular decorative fabric side panels each of which has first and second longer sides and first and second shorter ends, one of said side panels positioned along and connected to said first longer side of said bottom panel and the other of said side panels positioned along and connected to said second longer side of said bottom panel, a pair of generally rectangular decorative fabric end panels each of which has first and second sides and first and second ends, one of said end panels positioned along and connected to one of said first and second shorter ends of one of said side panels and the other of said end panels positioned along and connected to said one of said first and second shorter ends of the other said side panel, at least one of said panels fabricated as a pocket, and a semi-rigid sheet inserted into said pocket, wherein said at least one of said panels is said bottom panel.

* * * * *